US006239514B1

(12) United States Patent
Isberg et al.

(10) Patent No.: US 6,239,514 B1
(45) Date of Patent: May 29, 2001

(54) ELECTRIC SWITCHING DEVICE AND A METHOD FOR PERFORMING ELECTRIC DISCONNECTION OF A LOAD

(75) Inventors: Jan Isberg; Hans Bernhoff; Per Skytt, all of Västerås; Pan Min, Uppsala, all of (SE)

(73) Assignee: Asea Brown Boveri AB, Vasteras (SE)

( * ) Notice: Subject to any disclaimer, the term of this patent is extended or adjusted under 35 U.S.C. 154(b) by 0 days.

(21) Appl. No.: 09/210,666

(22) Filed: Dec. 14, 1998

(30) Foreign Application Priority Data

Dec. 15, 1997 (SE) ..... 9704685

(51) Int. Cl.[7] ..... H01H 35/00
(52) U.S. Cl. ..... 307/116; 218/18
(58) Field of Search ..... 218/8, 10, 18, 218/120, 123, 118, 21; 361/2, 13, 14; 307/116, 112, 126, 131, 137

(56) References Cited

U.S. PATENT DOCUMENTS

| | | | |
|---|---|---|---|
| 4,240,088 | 12/1980 | Myers | 357/19 |
| 4,626,884 | 12/1986 | Shannon | 357/30 |
| 4,760,483 | 7/1988 | Kugelman et al. | 361/13 |
| 4,779,126 | 10/1988 | Herman | 357/38 |
| 4,782,222 | 11/1988 | Ragle et al. | 250/211 R |
| 4,825,061 | 4/1989 | Schoenbach et al. | 250/211 R |
| 4,993,033 * | 2/1991 | Lin | 372/30 |
| 5,002,034 | 3/1991 | Herden et al. | 123/643 |
| 5,283,706 | 2/1994 | Lillemo et al. | 361/3 |
| 5,452,170 | 9/1995 | Ohde et al. | 361/13 |
| 5,548,461 * | 8/1996 | James | 361/13 |
| 5,592,053 | 1/1997 | Fox et al. . | |
| 5,663,580 | 9/1997 | Harris et al. . | |
| 5,689,395 | 11/1997 | Duffy et al. | 361/93 |
| 5,977,882 * | 11/1999 | Moore | 340/825.72 |

OTHER PUBLICATIONS

Triaros, C.P., et al., "Photoconductive Switches for AC Circuit Protection," IEEE Transactions on Electron Devices, vol. 37, No. 12, Dec. 1990, pp. 2526–2531.

* cited by examiner

*Primary Examiner*—Josie Ballato
*Assistant Examiner*—Robert L. DeBeradinis
(74) *Attorney, Agent, or Firm*—Connolly Bove Lodge & Hutz LLP

(57) ABSTRACT

An electric switching device comprises a quick mechanical electric switch and an irradiation source and at least one switching element sensitive to irradiation and adapted to create an electrically well conducting current path by-passing the electric mechanical switch upon irradiation thereon through the irradiation source, but assuming an electrically insulating state in absence of irradiation thereon. The quick mechanical electric switch is capable of being quickly de-ionized after extinction of an electric arc created therein upon separation of the contacts of the mechanical switch.

35 Claims, 4 Drawing Sheets

ELECTRIC SWITCHING DEVICE AND A METHOD FOR PERFORMING ELECTRIC DISCONNECTION OF A LOAD

TECHNICAL FIELD

The present invention relates to an electric switching device comprising a fast mechanical electric switch. The device is primarily intended for disconnecting high powers, for example when overcurrents occur.

The invention also relates to a method for performing electric disconnection of a load.

BACKGROUND OF THE INVENTION

The device may more exactly be intended for connecting and disconnecting objects in electric power plants or electric power net works as well as connecting and disconnecting parts thereof to or from other equipment included in the electric power plant or an object connected thereto. Accordingly, the term "object" is intended to have a very broad meaning and comprises any apparatuses and devices included in electric power plants and electric power networks as well as generally parts of the electric power plant and/or the electric power network.

It may as an example be mentioned that the object may be an electric apparatus having a magnetic circuit, for example a generator, transformer or motor Also other objects are conceivable, for instance power lines and cables, switchgear equipment etc. The present invention is intended to be used for medium and high voltages. According to the IEC-standard medium voltage means 1–72,5 kV, while high voltage is >72,5 kV. Accordingly, the transmission, subtransmission and distribution levels are included.

In electric power plants known circuit breakers, for instance $SF_6$-breakers, oil breakers or so-called vacuum breakers, have normally been used for connection and disconnection of the object in question. In some rare cases, in which there is a requirement of a very high speed, semiconductor "breakers", such as for example thyristors or IGBTs, may be used.

All such circuit breakers are so designed that they when breaking give rise to a galvanic separation of two metal contacts (arcing contacts), between which the current to be interrupted continues to flow in an arc. The interruption or breaking is then achieved by arranging the breaker so that this arc is extinguished upon a current zero passage, i.e. when the current through the breaker arrives at zero and change polarity, which takes place two times each twenty milliseconds in a 50 Hz-network. Accordingly, these circuit breakers function only for alternating current and not for direct current, where no zero passage occurs.

A circuit breaker with the construction according to above has to be designed to interrupt both in a large amount of breaking cases with comparatively moderate currents, so-called operation currents, but also in breaking cases with a high overcurrent, fault currents.

A circuit breaker has to be designed to be able to handle large amounts of energy when breaking an overcurrent in the arc between the arcing contacts. The gap between the contacts has to be brought to a very high dielectric strength within a short period of time after a current breaking has been successfully carried out so as to avoid reignition of an arc, i.e. guarantee the continued existence of the interruption.

Since circuit breakers, for example $SF_6$-breakers, oil breakers or so-called vacuum breakers, have to handle a high thermal and electric load in one and the same critical region within a short period of time, they will get a comparatively complex construction, which results in a comparatively long breaking time.

It is underlined that the overcurrent primarily intended here is a short-circuit current generated in connection to the object switched, for example as a consequence of a fault in the electric insulation system of the object switched. Such faults mean that the fault current (short-circuit current) of external network/equipment will tend to flow through an arc. This may lead to failure. It may also be mentioned that the maximum short-circuit current (fault current) the Swedish power network is dimensioned for is 63 kA. The short-circuit current may in reality be 40–50 kA.

A problem with such circuit breakers is the long breaking time thereof. The maximum breaking time (IEC-standard) for a breaking completely carried out is 150 milliseconds (ms). It is difficult to reduce this breaking time to under 90–130 ms depending on the operation case. The consequence of this is that a very high current will flow through the object switched upon a fault therein during the entire time required for bringing the circuit breaker to interruption. The total fault current of the external power network means a considerable stress on the object switched during this time. The operation of the network will during this time also be disturbed, so that other equipment connected to the network may be substantially disturbed or damaged. In order to avoid damages and total breakdowns with respect to the object switched this is constructed so that it may manage to be excerted to the short-circuit currents/fault currents during the breaking time of the circuit breaker without any damages worth mentioning. The need to construct the object switched so that it may take the short-circuit current/fault current during a considerable time results in substantial drawbacks in the form of more expensive constructions and lower performances. With respect to disturbances of the network and equipment connected thereto there is presently no protection integrated in the network, so that each manufacturer has to protect sensitive equipment with "backup" and network stabilizing assemblies. More sensitive equipment such as systems based on microprocessors, for example communication and computer systems, frequently requires a restart associated with considerable costs.

Semiconductor power devices, such as thyristors, MOSFETs and IGBTs, may not alone withstand the voltages in question, so that a number thereof have to be connected in series. Hundreds of such components have to be connected in series in some high voltage applications. This leads to a complicated control system of the equipment for ensuring the operation, i.e. that the voltage and power is distributed uniformly over the components. The use of semiconductor components made of silicon also results in comparatively high losses, which in turn, requires an efficient cooling, since the component may otherwise break down thermally. The total system with control, regulation and cooling all of the components connected in series individually on the individual voltage level thereof tends to become very complex and the entire system is therefore very costly. The costs may exceed those for circuit breakers considerably, which generally excludes the use of such semiconductor components in electric power plants and electric power networks for the applications discussed here.

SUMMARY OF THE INVENTION

The object of the present invention is to provide a device and a method making it possible to obtain a better switching and by that a reduced stress on the object switched and also a reduced disturbance of the network and equipment connected thereto at a cost being attractive in this context.

This object is according to the invention obtained by providing a device having the second electric switch is designed so that a switching element, which hereinafter is called shunt element, is connected in parallel with the first electric switch in the form of a quick mechanical electric switch, which accordingly will have contacts with metallic conductivity, The shunt element is so designed that it may be brought into an electrically conducting state through irradiation, for example by light or an electron beam. When a disconnection, i.e. an interruption, is carried out, the shunt element is exposed to irradiation, which brings the shunt element in a conducting state and the mechanical switch may be controlled to disconnect without any substantial thermal or electric load. The exposure of the shunt element to irradiation is preferably ceased when the breaker is in a separated position, which means that this element reduces its electrical conductivity.

By using a switch capable of being quickly de-ionized after extinction of an electric arc created therein upon separation of the contacts of the mechanical switch as fast mechanical electric switch it will be possible to start the disconnection operation by beginning to move the contacts apart and thus creating an electric arc therebetween and then with a delay with respect to the beginning of the movement of the contacts starting to irradiate the switching element and quickly achieving the disconnected state of the device. Thus, an electric arc is created, but it will be enough to irradiate the switching element during a short period of time to obtain the disconnected state, the time being long enough to obtain a de-ionization of the gap between the contacts to prevent the electric arc from returning when the irradiation is ceased. There are also considerable advantages with respect to the prior art devices when the device is brought into the conducting state, in which the switching element is irradiated, so that the mechanical electric switch may close without any transients.

Thus, the invention is based on the principle that the trust is not only put on a mechanical operation for opening and closing a circuit and that conventional power semiconductor components are not used with the high costs and the high losses connected thereto, but a switching device comprising a mechanical electric switch and a shunt element, the conductivity of which is controlled by irradiation, is instead utilized. This method to release the mechanical contact from electric and thermal stress during the very operation means that the breaker may be constructed so that a very quick interruption is obtained. The switching device will function well both for alternating and direct currents.

According to a preferred embodiment of the invention the mechanical electric switch is a vacuum interrupter. The use of a vacuum interrupter is very advantageous in an electric switching device of this type, since the gap between the contacts may be de-ionized in a very short time, such as in the order of 10 $\mu$s. This is due to the fact that the electric arc is burning in the metal vapor from the contacts in a vacuum interrupter, and when the current is ceased, here by closing the shunt element, the metal vapor escapes and adheres to the internal walls and the like of the interrupter, so that there are no ions to conduct current through the gap and the interruption will be completed. This means that it is enough to irradiate the switching element during a comparatively short period of time, so that a small amount of energy will be required to control the shunt element. This also means that it is possible to utilize new types of irradiators, such as light sources, which may only irradiate during a short period of time. Furthermore, the thermal stress on the irradiation source will also be reduced.

According to another preferred embodiment of the invention the device comprises a control unit adapted, when disconnecting, to first control the contacts of the first electric switch to move apart and when they have moved from the closed position of this switch moved at least a substantial part of the way to the maximum distance therebetween to control the second electric switch to form the electrically well conducting current path through irradiation of the switching element for a period of time being short in comparison to the time needed for the contacts of the first electric switch to move from the closing position to the fully spaced-apart position thereof. This means that a small amount of energy will be required to control the switching element, and the thermal load on the element will be relatively small.

According to another preferred embodiment of the invention being a further development of the embodiment last mentioned, the substantial part is the major part of the way to the maximum distance between the contacts. By waiting that long during the movement of the contacts to establish the by-pass through the switching element, very high voltages may be reliably interrupted after a short period of time of irradiation of the switching element for de-ionizing the gap between the contacts.

According to another preferred embodiment of the invention the control unit is adapted to control the second electric switch to form the electrically well conducting current path through irradiation of the switching element at the end of the movement of the contacts of the first mechanical switch apart. This means that a minimum of energy will be required for irradiation for reliably interrupting high voltages by the device.

According to another preferred embodiment of the invention the time of irradiation of the switching element is less than 1/10, preferably less than 1/50, of the time required for moving the contacts of the first mechanical switch from a closed position to a fully spaced-apart position when disconnecting. This means that the energy required for the irradiation of the switching element will be very small with respect to the case in which no formation of any electric arc in the mechanical switch would have been accepted and the by-passing by electrically well conducting current path had been maintained over the entire movement of the contacts from the closing to the open position. A very preferred possible relation between the length of time for irradiation of the switching element and the time needed to move the contacts of the mechanical switch from a closed to a fully spaced-apart position is according to a preferred embodiment of the invention about 10 $\mu$s to 1 ms.

According to a preferred embodiment of the invention the switching element has at least one layer made of a material with an energy gap between the valence band and conduction band of at least 2,5 eV. Such suitable "wide band gap materials" are for instance SiC, diamond, AlN, GaN and BN, and in particular such a switching element, made of SiC or diamond, will due to the characteristics of these materials be very advantageous in an electric switching device of this type. These two materials have both a very high breakdown voltage, so that a switching element may hold a considerably higher voltage when not irradiated than conventionally used switching elements made of semiconductor materials. This means that one such switching element may hold a voltage which would normally require a plurality of switching elements connected in series or fewer switching elements connected in series may be used than when using such switching elements of conventional materials for holding very high voltages. Furthermore, both SiC and diamond are stable at very high temperatures, well up to 1,000° K., which may be very useful when high electric powers are to be handled.

According to another preferred embodiment of the invention the switching element is a photoconductive element. This constitutes an easy way to control the switching element.

According to another preferred embodiment of the invention the second electric switch comprises a plurality of the switching element connected in series, which means that the device may function well when breaking very high voltages.

According to another preferred embodiment of the invention the device comprises a plurality of quick mechanical electric switches first mentioned connected in series and each having a second electric switch connected in parallel therewith. Such a device may be used for handling very high electric powers, and the quick mechanical electric switches will then advantageously be controlled simultaneously, as well as the second electric switches of the device.

According to another preferred embodiment of the invention at least one varistor is connected in parallel with the first electric switch and the switching element. Overvoltages which would be generated when breaking an inductive load induce a current in the varistor, in which the magnetic energy is absorbed. Accordingly, the varistor is used to absorb magnetic energy possibly stored in the interrupted circuit.

According to another preferred embodiment of the invention an electric switching device according to any embodiment of the invention mentioned above is used for connecting and disconnecting objects in an electric power plant to and from, respectively, an electric power network or another equipment included in the electric power plant. This is an advantageous use of an electric switching device of this type, since the problems of rapidly connecting and disconnecting objects are particularly accentuated there.

The invention also comprises a method for performing electric disconnection of a load, especially for disconnecting high electric powers, by means of a quick mechanical electric switch, in which a second electric switch connected in parallel with the first mechanical electric switch and comprising an irradiation source and a switching element sensitive to irradiation, is brought to form an electrically well conducting current path by-passing the first electric switch through irradiation thereof by the irradiation source after the contacts of the first electric switch have been moved a substantial part of their way from the closed position to the fully spaced-apart position, so that the switching element is then brought to go from an electrically insulating state to an electrically conducting state and the first electric switch is de-ionized during the period of time of conduction of the switching element. This method has the advantages discussed above with respect to the possible irradiation sources and the low energy needed for appropriately controlling the switching elements by irradiation thereof mentioned above.

Further advantages and preferred features of the invention appear from the following description and the other dependent claims.

BRIEF DESCRIPTION OF THE DRAWINGS

With reference to the appended drawings, below follows a specific description of preferred embodiments of the invention cited as examples.

In the drawings.

DETAILED DESCRIPTION OF PREFERRED EMBODIMENTS

Figure 1:
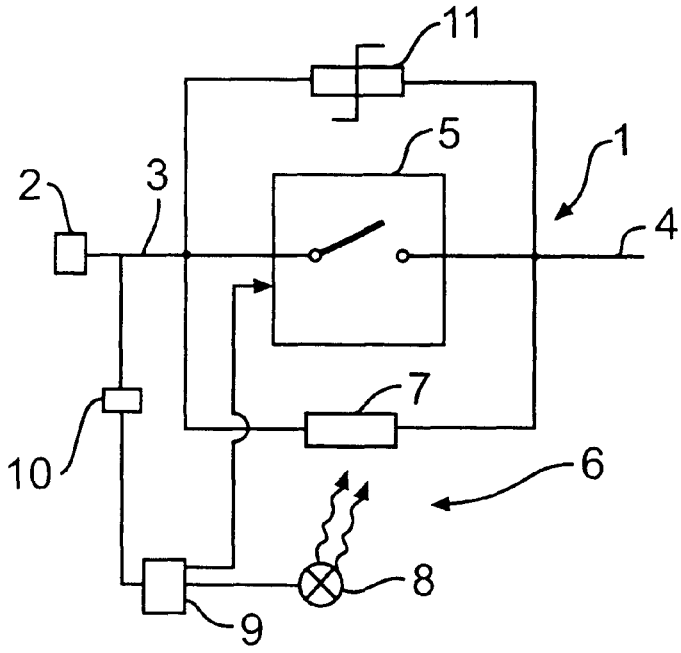
FIG. 1 is a very schematic view illustrating the most essential parts of an electric switching device according to a first preferred embodiment of the invention.

An electric switching device 1 according to a first preferred embodiment of the invention is very schematically illustrated in FIG. 1. This device is arranged in an electric power plant having a switched object 2, such as a generator. This object is through a line 3 connected to an external electric power supply network 4. The electric switching device is arranged to switch, i.e. connect and disconnect the object 2 and the power network 4. However, it is emphasized that switching of the object may take place with respect to any other part of the electric power plant. The disconnection of the object 2 with respect to the network may either take place for protecting the object against fault currents from the network or the equipment or for protecting the network/equipment against voltage and operational disturbances that would result from a high fault current towards the object.

The switching device comprises a first electric switch 5 in the form of a quick mechanical switch having two contacts controlled to move apart for breaking and into contact with each other for closing the switch. This mechanical switch is in the present case a switch capable of being quickly de-ionized after extinction of an electric arc created therein upon separation of the contacts of the switch, and is in this embodiment a vacuum interrupter. A second electric switch 6 is connected in parallel with the first switch 5 and comprises a switching element in the form of a photoconductive element 7. The second electric switch also comprises an irradiation source 8 adapted to irradiate the element 7 for bringing it into a conducting state as long as it is irradiated. As soon as the irradiation of the switching element 7 is stopped the switching element will be "open"—accordingly in a non-conducting blocking state. Thus, the switching element is controlled by means of the irradiation source, electrically separated from the element.

Furthermore, the device has also a control unit 9 adapted to control the light source 8 and the mechanical switch 5. This unit is connected to a sensor 10 adapted to detect parameters indicating the presence of an overcurrent in the line 3.

A varistor 11 is connected in parallel with the mechanical switch 5, and the function thereof will be explained further below.

The electric switching device is very fast as compared with a conventional circuit breaker, which means that the fault current in the line 3 will not rise to the maximum level. It is also desired to minimize the inductances in the commutation circuit and the commutation time as much as possible by a suitable design of the commutation circuit.

Figure 4:
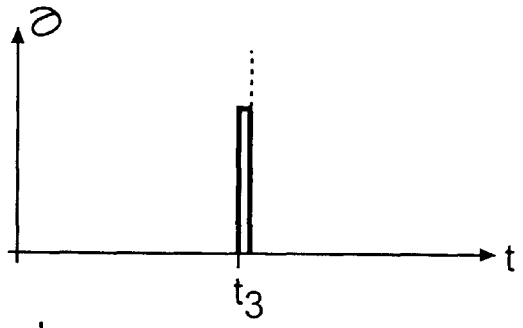
FIG. 4 is a diagram illustrating the electric conductivity of the photoconductive switching element in the device according to FIG. 1 versus time when the electric switching device disconnects a load.
Figure 5:
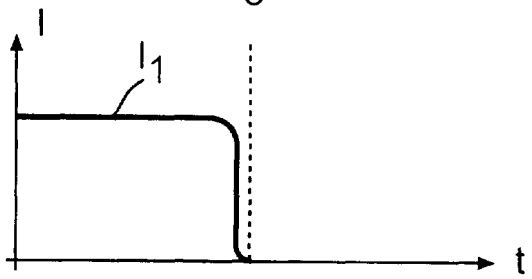
FIG. 5 is a diagram illustrating the current $I_1$ through the mechanical electric switch of the device according to FIG. 1 versus time when disconnecting a load.
Figure 6:
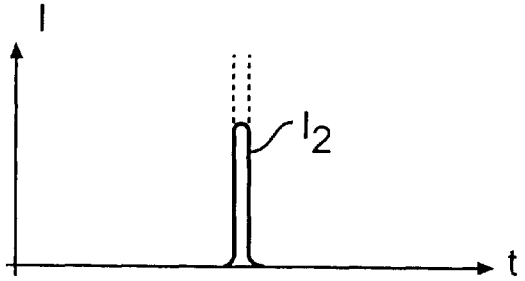
FIG. 6 is a diagram illustrating the current $I_2$ through the switching element of the device according to FIG. 1 versus time when disconnecting a load.
Figure 7:
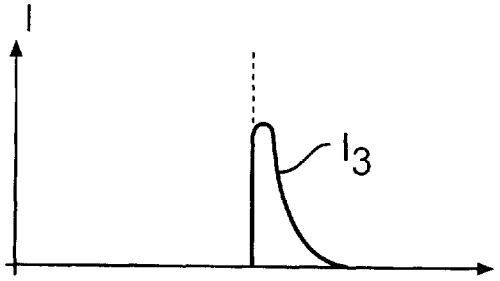
FIG. 7 is a diagram illustrating the current $I_3$ through the varistor of the device according to FIG. 1 versus time when disconnecting a load.

FIGS. 3–7 illustrates what's happening when an overcurrent has been detected by the sensor 10 and the control unit 9 controls the switching device to disconnect the object 2 from the network/equipment 4. At a point of time $t_1$ corresponding to the point of time for the detection of an overcurrent the vacuum interrupter is controlled to start to separate the contacts, and these move apart according to the line in FIG. 3 indicating the distance between the two contacts. Accordingly, the fully spaced-apart position of the contacts is reached at a point of time $t_2$, which may be approximately 1 ms later than $t_1$, FIG. 5 illustrates how the current $I_1$ (see also FIG. 2) continues to flow between the contacts in the vacuum interrupter in the form of an electric arc after the separation has been started ($t_1$). The light source 8 is controlled to start to irradiate the switching element 7 at a point of time $t_3$ at which the contacts of the vacuum interrupter have moved a substantial part of the way to the maximum distance $x_1$ therebetween. In the present case $t_3$ is located at the very end of the movement of the contacts apart, namely during the last 10 $\mu$s of this movement. It is illustrated in FIG. 4 how the electrical conductivity $\sigma$ of the switching element is changed as a consequence of irradiation thereof, and FIG. 6 illustrates the current $I_2$ through the switching element 7 versus time. The switching element 7 will only be irradiated during a short period of time, such as 10 $\mu$s, and the disconnection of the object 2 with respect to the network/equipment 4 will then have been completed. FIG. 7 illustrates the current $I_3$ through the varistor 11 versus time, and it may be seen that the varistor is conducting a short period of time after the irradiation of the switching element has ceased, and the interruption is completed when $I_3$ disappears.

The consequences of this way of controlling the two electric switches connected in parallel will be as follows. When the contacts of the vacuum interrupter 5 start to move apart an electric arc is formed in the gap between these contacts. When the irradiation source 8 starts to irradiate the switching element 7 at $t_3$ an electrically well conducting current path by-passing the vacuum interrupter will be formed, so that the current will now flow through the switching element instead. This means that the electric arc in the vacuum interrupter will be extinguished and the gap between the contacts thereof will be de-ionized very fast, namely there will be a vacuum therein as soon as the metal vapor resulting from the electric arc near the contacts has disappeared and adheres to the interior walls of the vacuum interrupter. This will be achieved in a short period of time, in the order of 10 $\mu$s. The electric interruption of the current path is then taking place in the switching element 7 (shunt element), when the irradiation thereof is ceased, and the current may not return to the gap between the contacts of the vacuum interrupter after that, since there will be a complete vacuum in this gap and the interruption or disconnection will be completed. This means that a substantial part of electric or thermal stress during the disconnection procedure will be taken by the switching element 7. Magnetic energy possibly remaining is absorbed in the varistor 11. Thus, it is possible to allow an electric arc to be formed in the electric mechanical switch and still obtain a very quick disconnection by the switching device, since a mechanical electric switch capable of being quickly de-ionized after extinction of an electric arc is used, so that it will be enough to divert the current through the device to the photoconductive switching element for a short period of time for de-ionizing the gap and completing the interruption. This would not be possible for a conventional switch having for instance air between the gaps, since it would then be necessary to remove the current from the mechanical switch for such a long time that the plasma in the gap has cooled down, which will take a considerable time. It is very advantageous that the period of time necessary for obtaining a disconnection by irradiation of the switching element 7 is short, since this means that a small amount of energy is required to control the irradiation source 8. This also means that the thermal stress on the irradiation source is reduced, and that new types of irradiation sources being able to only irradiate a short period of time may be used, which means that additional costs may be saved.

Figure 8:
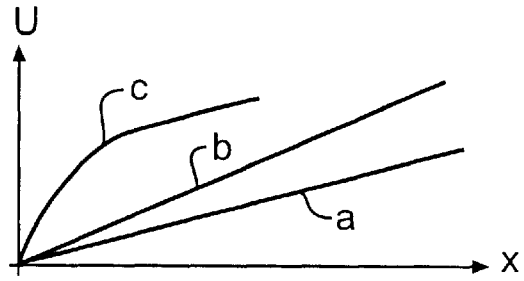
FIG. 8 is a diagram illustrating the returning voltages that an electric mechanical switch may withstand versus the distance between the contacts thereof for different environments of the contact.
Figure 9:
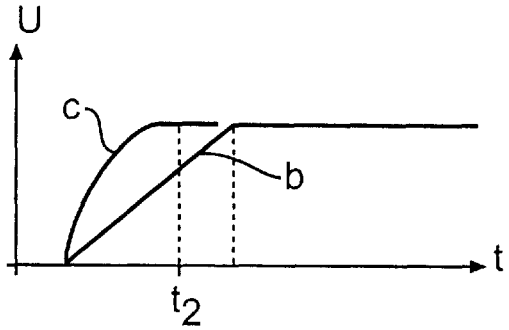
FIG. 9 is a diagram illustrating a change of the returning voltage acceptable without jeopardizing the interruption of an electric mechanical switch versus time when going from the closed state to the opened state for a vacuum interrupter and an interrupter having another medium in the gap between the contacts.

FIG. 8 illustrates how the maximum voltage U returning across a gap after de-ionizing thereof without any reignition of an electric arc is dependent upon the distance x between two contacts defining gap for a gap of air a, a gap of $SF_6$ b and a gap of vacuum c as in a vacuum interrupter. It may be seen that this voltage withstand of the gap will increase much more rapidly for a gap of vacuum in the beginning of the movement of the contacts apart. On the other hand, this means that this voltage will have an acceptable level earlier than in the case of air or $SF_6$, so that it will be possible to obtain an interruption at a point of time $t_2$ being closer to the point of time for the detection of an overcurrent, so that any negative consequences thereof may be reduced.

Figure 2:
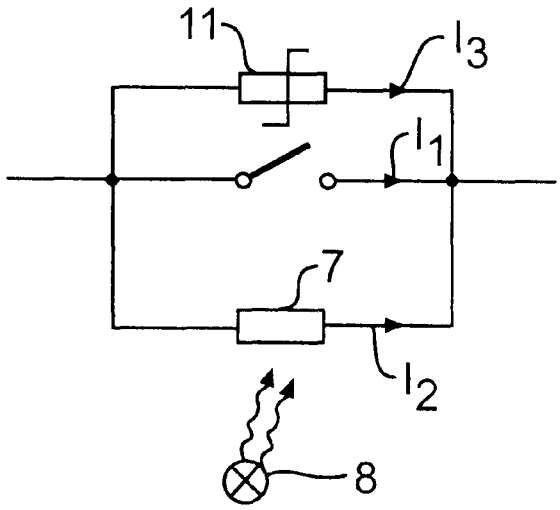
FIG. 2 is a very schematic view of a part of the switching device according to FIG. 1 used to explain the function of the switching device according to the invention in association with FIGS. 3–9.
Figure 3:
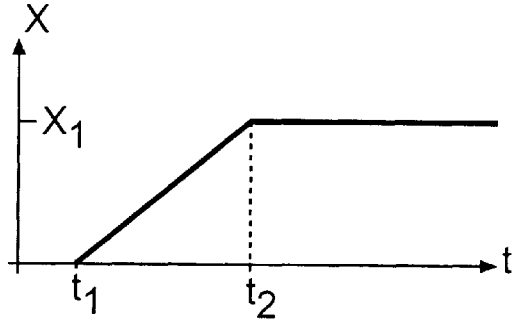
FIG. 3 is a diagram illustrating the distance x between two contacts in a mechanical electric switch in the electric switching device according to FIG. 1 versus time when disconnecting.
Figure 10:
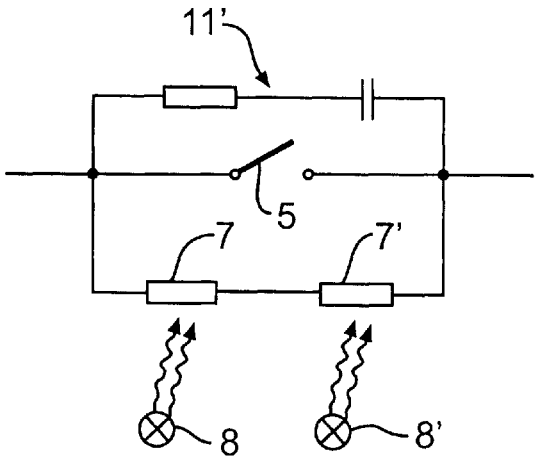
FIGS. 10–13 are schematic views of electric switching devices according to second, third, fourth and fifth embodiments, respectively, of the present invention.

A part of an electric switching device according to a second preferred embodiment of the invention is very schematically illustrated in FIG. 10, and this differs from that shown in FIGS. 1 and 2 by the fact that there are two switching elements 7, 7' connected in series in parallel with one mechanical switch 5. An irradiation source 8, 8' is arranged for each switching element. This means that the breakdown voltage of the switching elements will not restrict the ability of the switching device to hold high voltages. It will of course be possible to connect as many switching elements as desired in series for improving the ability to hold high voltages. A RC-circuit 11' is preferably connected across each switching element for absorbing magnetic energy and for ensuring that the two switching elements 7, 7' will equally share the power and the voltage developed upon disconnecting. This RC-circuit may just as well be replaced by a varistor. It should be mentioned, that a disconnecter may be arranged between the switching elements 7 and the network/equipment 4 and be controlled to disconnect the network/equipment 4 from the switching element/elements after the disconnection of the object 2 from the network/equipment for achieving galvanic separation from the switching elements in the disconnected state.

Figure 11:
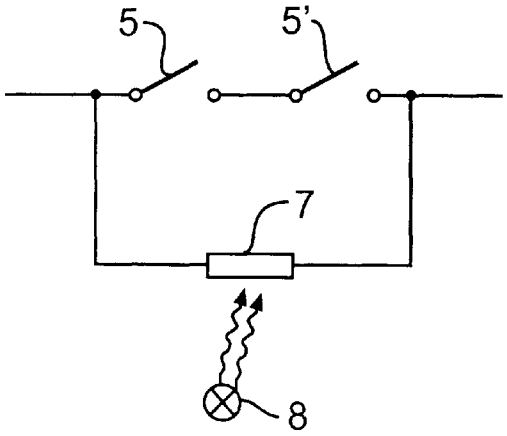

A further preferred embodiment of the invention is shown in FIG. 11. In this case two mechanical electric switches 5, 5' are connected in series and one switching element 7 is connected across these mechanical switches. This embodiment may be interesting when the material of the switching element has a very high breakdown voltage, as in the case of using intrinsic diamond, so that very high voltages may be held by the switching element.

Figure 12:
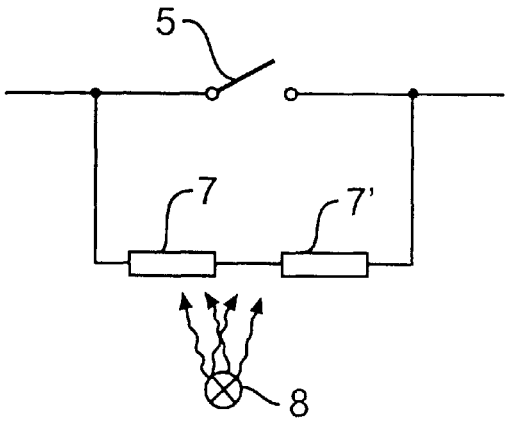

Another preferred embodiment of the invention is shown in FIG. 12, and it differs from that shown in FIG. 10 by the fact that one single irradiation source 8 is used to irradiate two switching elements 7, 7'. It would of course also be possible to arrange an irradiation source to irradiate more than two switching elements.

Figure 13:
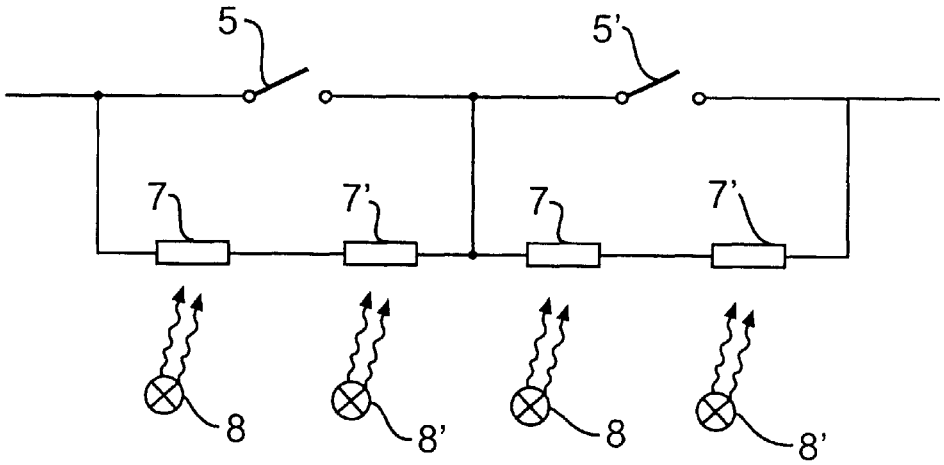

A further preferred embodiment of the invention is shown in FIG. 13. In this case two mechanical electric switches 5, 5' are connected in series, and two switching elements 7, 7' are connected across each mechanical switch. Accordingly, this device is suitable for handling higher voltages.

It should be noted that the switching performances of the individual switching elements depend upon the material used therefore, and it may be mentioned that the use of "wide band gap materials", such as SiC, intrinsic diamond, AlN, GaN or BN in these switches will result in switches able to hold much higher voltages, each perhaps in the region of 10 kV or higher. Accordingly, the number of switching elements connected in series, the complexability of the equipment controlling them and by that the costs may then be reduced. Si may also be used as material for such a switching element The invention is of course not in any way restricted to the preferred embodiments described above, but many possibilities of modifications thereof would be apparent to a man with ordinary skill in the art without departing from the basic idea of the invention as defined in the appended claims.

The number of switching elements, mechanical switches and the like may of course be arbitrarily varied.

The irradiation source may be of any type utilizing for instance visible light, UV-light, IR-light, or any form of coherent radiation (e.g. from a laser), electron beams, ion beams, x-ray radiation and so on.

Finally, it is pointed out that the switching device according to the invention is not only suited for used to interrupt overcurrents but it may also be used to interrupt and establish a current path at normal operation conditions.

What is claimed is:

1. An electric switching device comprising a first quick mechanical electric switch wherein a second electric switch is connected in parallel with the first electric switch, said second electric switch comprising a separate irradiation source controlled by a control unit and at least one switching element sensitive to irradiation and adapted to create an electrically well conducting current path bypassing the first electric switch upon irradiation of the at least one switching element through the irradiation source, but assuming an electrically insulating state in absence of irradiation of the at least one switching element, and wherein the first quick mechanical electric switch is a switch capable of being quickly de-ionized after extinction of an electric arc created therein upon separation of contacts of the first mechanical switch.

2. A device according to claim 1, characterized in that said mechanical electrical switch (5) is a vacuum interrupter.

3. A device according to claim 1, wherein said control unit is adapted, when disconnecting the contacts, to first control the contacts to move apart and when the contacts have moved from a closed position of the first switch at least a substantial part of a way to a maximum distance between the contacts corresponding to a fully spaced-apart position, to control the second electric switch to form said electrically well conducting current path through irradiation under control of said control unit of the switching element for a period of time being short in comparison to the time needed for the contacts of the first electric switch to move from the closed position to the fully spaced-apart position thereof.

4. A device according to claim 3, wherein said substantial part is a major part of said way to the maximum distance between the contacts.

5. A device according to claim 4, wherein said control unit is adapted to control the second electric switch to form the electrically well conducting current path through irradiation of the switching element (7) at the end of the movement of the contacts of the first mechanical switch apart.

6. A device according to claim 3, wherein the time of irradiation of said switching element is less than 1/10, preferably less than 1/50, of the time required for moving the contacts of the first mechanical switch from a closed position to a fully spaced-apart position when disconnecting.

7. A device according to claim 3, wherein the first electric switch needs about 1 ms to move the contacts from a closed to a fully spaced apart position, whereas the length of time for irradiation of said switching element for forming said electrically well conducting current path is in the range of 10 $\mu$s.

8. A device according to claim 1, wherein said switching element is a semiconductor device having at least one layer made of a material with an energy gap between the valence band and conduction band of at least 2,5 eV.

9. A device according to claim 8, wherein said switching element is a semiconductor device having at least one layer made of SiC.

10. A device according to claim 8, wherein said switching element is a semiconductor device having at least one layer made of diamond.

11. A device according to claim 1, wherein said switching element (7) is a photoconductive element.

12. An electric switching device comprising:

a first quick mechanical electric switch, the first quick mechanical electric switch being a vacuum interrupter capable of being quickly de-ionized after extinction of an electric arc created therein upon separation of contacts of the mechanical switch;

a second electric switch connected in parallel with the first electric switch, said second electric switch comprising a separate irradiation source controlled by a control unit and further comprising at least one switching element sensitive to irradiation and adapted to create an electrically well conducting current path by-passing the first electric switch upon irradiation thereon through the irradiation source, but assuming an electrically insulating state in the absence of irradiation thereon; wherein said control unit is adapted, when disconnecting the contacts, to first control the contacts of the first electric switch to move apart, and when the contacts have moved from a closed position of the first electric switch at least a substantial part of a way to a maximum distance between the contacts corresponding to a fully spaced-apart position, to control the second electric switch to form said electrically well conducting current path through irradiation of the switching element for a period of time being short in comparison to the time needed for the contacts of the first electric switch to move from the closed position to the fully spaced-apart position thereof.

13. A device according to claim 12, wherein said substantial part is a major part of said way to the maximum distance between the contacts.

14. A device according to claim 13, wherein said control unit controls the second electric switch to form the electrically well conducting current path through irradiation of the switching element at the end of the movement of the contacts of the first mechanical switch apart.

15. A device according to claim 12, wherein the time of irradiation of said switching element is less than 1/10, of the time required for moving the contacts of the first mechanical switch from a closed position to the fully spaced-apart position when disconnecting.

16. A device according to claim 12, wherein the first electric switch requires about 1 ms to move the contacts from a closed to the fully spaced apart position, whereas the length of time for irradiation of said switching element for forming said electrically well conducting current path is about 10 $\mu$s.

17. A device according to claim 12, wherein said switching element is a semiconductor device having at least one layer made of a material with an energy gap between the valence band and conduction band of at least 2.5 eV.

18. A device according to claim 17, wherein said switching element is a semiconductor device having at least one layer made of SiC.

19. A device claim 17, wherein said switching element is a semiconductor device having at least one layer made of diamond.

20. A device according to claim 12, wherein said switching element is a photoconductive element.

21. A device according to claim 20, wherein one irradiation source is adapted to irradiate more than one switching element.

22. A device according to claim 12, wherein said second electric switch comprises a plurality of said switching elements connected in series.

23. A device according to claim 12, further comprising a plurality of said quick mechanical electric switches connected in series and each having a second electric switch connected in parallel therewith.

24. A device according to claim 12, further comprising a plurality of quick mechanical electric switches connected in series and having at least one second electric switch connected in parallel therewith.

25. A device according to claim 12, wherein at least one means for absorbing magnetic energy generated upon disconnection of the device is connected in parallel with the first electric switch and the switching element.

26. A device according to claim 25, wherein said means for absorbing magnetic energy is a varistor.

27. A device according to claim 25, wherein said means for absorbing magnetic energy is a RC-circuit.

28. A device according to claim 12, wherein the switching element and the irradiation source are electrically separated from each other.

29. A device according to claim 12, wherein the control unit is connected to the first and second electric switches so as to control the function thereof depending upon information signals arriving at the control unit.

30. A device according to claim 29, further comprising an arrangement for detecting overcurrent conditions, and being connected to the control unit so as to deliver information thereto about conditions indicating overcurrents.

31. A device according to claim 12, adapted to quickly connect and disconnect objects to and from, respectively, an electric power network in an electric power plant or another equipment included in the electric power plant, said first and second electric switches being connected in a line between the object and a net-work/equipment.

32. A device according to claim 12, adapted for use for intermediate and high voltages above one kV, suitably above 5 kV, especially above 10 kV, preferably above 20 kV, in particular above 40 kV and more particularly above 72 kV.

33. A use of an electric switching device according to claim 12, for connecting and disconnecting objects in an electric power plant to and from, respectively, an electric power grid or another equipment included in the electric power plant.

34. A device according to claim 12, wherein the time of irradiation of said switching element is less than 1/50 of the time required for moving the contacts of the first mechanical switch from a closed position to the fully spaced-apart position when disconnecting.

35. A method for performing electric disconnection of a load, especially for disconnecting high electric powers, by means of a first quick mechanical electric switch, said method including the steps of: connecting a second electric switch in parallel with the first mechanical electric switch, said second switch comprising a separate irradiation source controlled by a control unit and further comprising a switching element sensitive to irradiation, said second switch being adapted to form an electrically well conducting current path by-passing the first electric switch through irradiation of the switching element by the irradiation source under control of said control unit after contacts of the first electric switch have been moved a substantial part of a way from a closed position of the first electrical switch to a maximum distance between the contacts corresponding to a fully spaced-apart position, and bringing said switching element from an electrically insulating state to an electrically conducting state so that the first electric switch is de-ionized during the period of time of conduction of said switching element.

* * * * *